US005676558A

United States Patent [19]

Mayer

[11] Patent Number: 5,676,558

[45] Date of Patent: Oct. 14, 1997

[54] REDUCED CABLE REQUIRING, FUSIBLE BUS DUCT SYSTEM AND METHOD FOR PROVIDING ELECTRICAL ENERGY TO HOUSES AND BUILDINGS AND THE LIKE

[76] Inventor: E. Howard Mayer, 209 Williamsburg Dr. #5, Thiensville, Wis. 53092

[21] Appl. No.: 538,006

[22] Filed: Oct. 2, 1995

[51] Int. Cl.[6] ..... H01R 25/14

[52] U.S. Cl. ..... 439/209; 174/49

[58] Field of Search ..... 439/209, 216, 439/215, 207, 208, 210–214, 120; 174/48, 49, 71 B

[56] References Cited

U.S. PATENT DOCUMENTS

| | | | |
|---|---|---|---|
| 2,175,144 | 10/1939 | Davison | 439/209 |
| 2,175,148 | 10/1939 | Davison | 439/216 |
| 2,320,332 | 5/1943 | Morten | 439/209 |
| 2,383,014 | 8/1945 | Morten et al. | 439/216 |
| 2,384,487 | 9/1945 | O'Brien | 439/216 |
| 2,478,006 | 8/1949 | Paden | 439/120 |
| 2,899,668 | 8/1959 | Gribben | 439/120 |
| 3,012,217 | 12/1961 | Pantin | 439/120 |
| 3,061,810 | 10/1962 | Boyd | 439/120 |
| 3,083,307 | 3/1963 | Williams et al. | 174/49 |
| 3,308,416 | 3/1967 | Boyd | 439/120 |
| 3,657,606 | 4/1972 | Greger et al. | 439/213 |
| 3,710,302 | 1/1973 | Shannon et al. | 439/142 |
| 3,821,688 | 6/1974 | Larsile | 439/209 |
| 4,094,561 | 6/1978 | Wolff et al. | 439/209 |
| 4,134,633 | 1/1979 | Kraure et al. | 439/110 |
| 4,825,540 | 5/1989 | Kelly | 439/209 |
| 4,875,871 | 10/1989 | Booty, Sr. et al. | 439/209 |
| 4,897,048 | 1/1990 | Liebon et al. | 439/211 |
| 5,192,217 | 3/1993 | Wittmer | 439/211 |

FOREIGN PATENT DOCUMENTS

| | | | |
|---|---|---|---|
| 1178086 | 5/1959 | France | 439/209 |
| 1503562 | 12/1967 | France | 439/209 |

*Primary Examiner*—Gary F. Paumen
*Attorney, Agent, or Firm*—James D. Welch

[57] ABSTRACT

A System and Method of providing Electrical Energy to houses and buildings and the like, which reduces cable length requirements, is disclosed. The System comprises essentially continuously accessible Bus Duct System and essentially continuously accessible Electric Receptacle Providing Baseboard Systems in combination. The Electric Receptacle Providing Baseboard System provides an easily accessible raceway for running telephone, computer, temperature control, security and audio and the like wiring. Sections of present invention Bus Duct System and Electric Receptacle Providing Baseboard System are interconnected by Through Couplers and last sections thereof are secured by End Caps. Fuseable Element Containing Disconnect System-Cable-Baseboard Supply End Cap Contact Element Coupling Systems serve to electrically interconnect Bus Duct Busbars and Electrical Contact Elements in Electrical Receptacle Providing Baseboard Systems. Practice of the Method of installation of the present invention requires that only short runs of cabling are required.

3 Claims, 5 Drawing Sheets

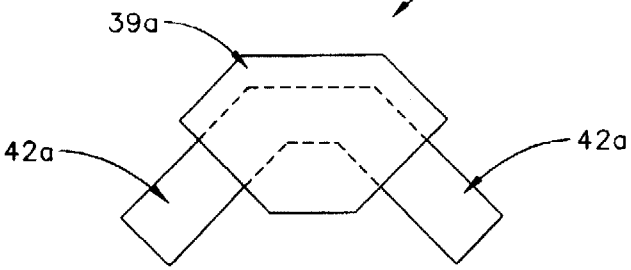
FIG. 9
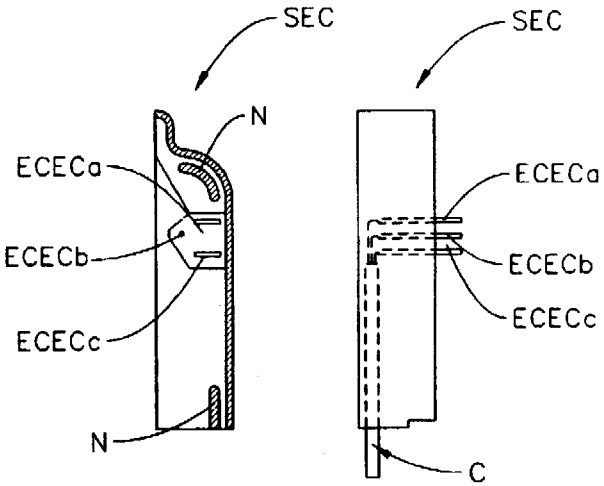
FIG. 10b
FIG. 10a
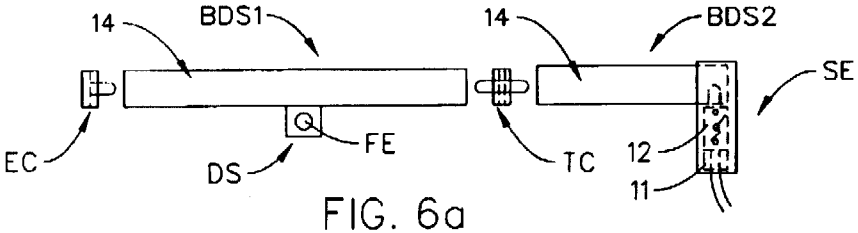
FIG. 6a
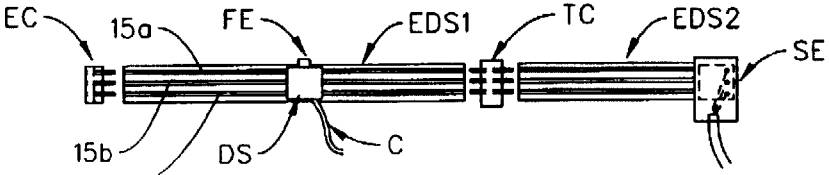
FIG. 6b
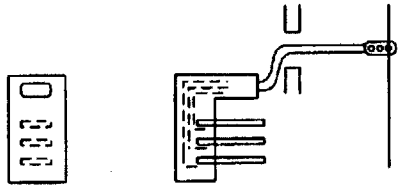
FIG. 7a
FIG. 7b
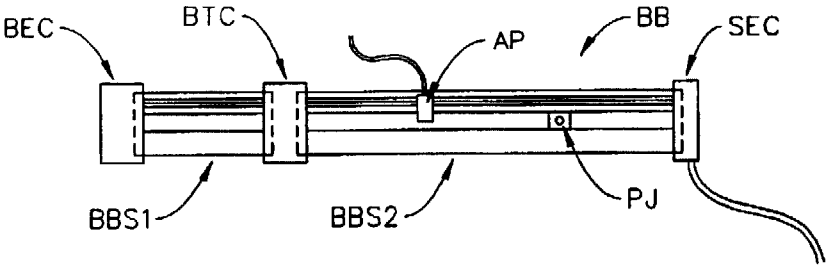
FIG. 8

REDUCED CABLE REQUIRING, FUSIBLE BUS DUCT SYSTEM AND METHOD FOR PROVIDING ELECTRICAL ENERGY TO HOUSES AND BUILDINGS AND THE LIKE

TECHNICAL FIELD

The present invention relates to systems and methods for providing electrical energy to houses and buildings and the like, and more particularly is a system, and method of its use, which reduces the length of cabling required, which system is comprised of an essentially continuously accessible Bus Duct System for use in electrical energy distribution, in combination with essentially continuously accessible Electric Receptacle Providing Baseboard Systems. Said Electric Receptacle Providing Baseboard Systems conveniently provide essentially continuously accessible electric receptacles and an easily accessible raceway for routing contained additional wiring, (eg. for telephone, computer, temperature control, security, and audio and the like systems). Short-run cabling provides interconnection between said Bus Duct system and said Electric Receptacle Providing Baseboard Systems, and between said Bus Duct system and other electrical systems, such as lighting systems. Modular Fuseable Element Containing Disconnect Systems, are present between said Bus Duct System and said Electrical Receptacle Providing Baseboard Systems and/or other electrical systems.

BACKGROUND

Present practice for providing electrical energy to houses and buildings and the like involves providing, typically near a Service Entrance, a number of fuseable elements, (eg. fuses and circuit breakers are particularly relevant examples), in a common Panel. Wiring, (eg. typically "BX Cable"), is typically run from each utilized fuseable element to electrical boxes at locations within the house or building and the like, electrical energy access to which is to be controlled by said fuseable element. This approach necessitates the drilling of boles through house or building and the like wall supporting means (studs etc.), and securing the ends of wires in said cables at electrical boxes, (eg. receptacles, switches etc.), by, for instance, screws. Typically, additional lengths of cabling will be originated at an electrical box and run in a similar manner to other electrical boxes. It will be appreciated that said approach to providing electrical energy access requires that numerous lengths of "BX Cables" be run from a distantly located common Panel, wherein are present a multiplicity of Fuseable Elements, to provide selective electrical energy access control by specific Fuseable Elements present in said Panel. For this reason, a great deal of BX Cable, (or equivalent), is typically necessary to properly wire a house or building and the like. Considering that it is preferred practice to provide separate fuseable element control for lighting, and for electrical receptacles, in an area of a house or building and the like, it is not unusual, for instance, to find ten (10) to twenty (20) or more BX Cables, each of a significant length, exiting from a common fusible element containing Panel. In addition, it should be appreciated that the placement of individual electrical receptacle systems in a room of a house or building and the like is often dictated by ease of installation concerns of an electrician, rather than end user convenience. As a result, end users are often forced to use extension cords and octopus outlets to utilize inconveniently positioned installed electrical receptacles.

One can appreciate that materials and installation costs associated with providing electrical energy to houses and building and the like, by the above alluded to typical practice, can be, and often are, very high. In addition, the fact that typical practice provides that BX Cable be directly run through flammable wood studs and walls and the like, it can be appreciated that safety is a concern. As said BX Cable ages, or mice for instance gnaw away insulation therefrom, or nails are pounded into a wall, wiring in BX cables can be caused to short out in direct contact with flammable materials. Even when run in conduit, wires in cables can, under stressed circumstances, short to a conduit, burn therethrough, and cause fires.

A system and method of application thereof which would provide that electrical distribution be accomplished predominately by a safely enclosed prefabricated Bus Duct System, with only relatively short runs of cabling being required to interconnect said Bus Duct System with end user accessible electrical receptacles and lighting systems and the like, would therefore be of utility. In addition, an electrical receptacle system which would provide essentially continuous end user accessability to electrical energy anywhere in a room of a house or building and the like, would negate the need for installed cables between electrical outlet providing electrical boxes, and, after installation, necessitated end user use of extension cords and octopus outlets etc. Such a system and method would also allow the location of Fuseable Element Containing Disconnect Systems to be conveniently positioned near the electrical entrance to a room of a house or building and the like, with said Fusible Element Containing Disconnect System being, preferably, plugged into said Bus Duct System, with actual Fusible Elements being conveniently located near the room served. As anyone who has ever had to use a flashlight in a dark basement location to find a blown fuseable element, (amongst many), at a common fusible element containing Panel will agree, this would be very end user convenient. As well, providing separate Fused Element Containing Disconnect Systems for the lighting, and for the electrical receptacles, in a room of a house or building and the like, would be simplified as duplicate lengths of BX Cable would not have to be run from a distantly located Fusible Element containing Panel for each said circuit. Simply tapping the closely situated Bus Duct at two relatively closely situated locations would suffice.

It should be specifically appreciated that a Bus Duct System utilized as a means to predominately provide electrical distribution in a house or building and the like, would be of factory prefabricated construction. Thus, Bus Duct System containment related safety concerns associated with electrical energy distribution, could be handled at a Bus Duct System fabrication stage, rather than left to individual electrician determination on a job by job basis, (regarding how BX Cable should be routed for instance). Similarly, safety concerns regarding electrical receptacles could also be handled by providing essentially continuously accessible electrical receptacle containing factory prefabricated Electric Receptacle Providing Baseboards.

A Search for relevant prior Patents has provided art in the areas of Bus Ducting, plug locking means and essentially continuously accessible electrical receptacle containing Baseboards.

A Patent, U.S. Pat. No. 4,897,048 to Liebon et al, for instance, describes a prefabricated electrical Bus Duct comprising a protective casing in which are present a plurality of parallel longitudinally oriented grooves with current carrying "U" shaped bars housed in each. A plurality of taps, spaced evenly apart over the length of the casing, provide access to the conducting bars. While the Liebon et al. system might be considered as a means for providing electrical receptacle access, the receptacles involved are not essentially continuous, and thereby do not provide end user access to electrical energy at any point therealong. As well, there is no provision of a fused disconnect at the input thereto.

Another U.S. Pat. No. 4,134,633 to Krause et al, describes a busway section comprised of a plurality of elongated insulator coated flat busbars. Present as well are aperatures which are free of insulation, into which apertures electrical contacting bus plug stabs can be inserted to access electrical energy.

A Patent to Greger et al., U.S. Pat. No. 3,657,606 describes a plug-in unit which is hooked into notches of a bus duct. An interlock prevents plugging into a bus when its in an "on" mode. The plug openings are not essentially continuous.

A Patent to Shannon et al., U.S. Pat. No. 3,710,022, describes a system for locking a plug into a bus duct by a pivoting motion. The outlets are not essentially continuous.

A British Patent, No. DE 3346-381-A describes a multiple point connector with predetermined outlets and intermediate construction between the bus duct and plugs which insert thereinto. There is not provision for fused disconnects.

A Patent, U.S. Pat. No. 2,478,006 to Paden describes a continuous electrical receptacle comprised of an extruded body with a pair of electrical conductors retained in grooves therein. U.S. Pat. No. 3,308,416 to Boyd describes a similar system.

U.S. Pat. No. 3,012,217 to Pantkin describes a continuous electric outlet system adapted to accommodate a plurality of outlet plugs, with a hollow molded plastic member provision for accommodating cables for special application, but it is not easily accessible along its length.

It is also noted that no known continuous electrical outlet system provides for the presence of more than two prong plug access. Modern House and building and the like electrical systems require two "Hot" leads and a ground. As well, no known reference provides for the combination of a Bus duct provided source of electrical energy and essentially continuous electrical sockets, and provides means for providing electrical energy to auxilliary equipments.

While the above summary of known prior Patents shows that inventors have realized the benefits associated with the use of Bus Duct Systems and essentially continuously accessible electrical receptacle systems, no known reference teaches that Bus Duct Systems with contained essentially continuously accessible Busbars, and continuously accessible Electric Receptacle Providing Baseboard Systems, should be combined into a required cable length reducing, safe to utilize, easy to install system for providing electrical energy to Houses and buildings and the like, which combined systems provide for modular electrical Fused Element Containing Disconnect Systems near electrical loads, (rather than at a distantly located common multiple fusible element containing Panel), and which continuously accessible Electric Receptacle Providing Baseboard System also provides an easily accessible raceway for containing additional wiring for telephone, computer, temperature control, security, and audio and the like systems. As well, no known reference teaches a Method of utilizing such a combined system to allow relatively quick, safe, inexpensive provision of, and maintenance of, electrical energy throughout a house or building and the like.

The present in invention responds to the identified state of the art.

DISCLOSURE OF THE INVENTION

In its most general sense, the system of the present invention is a means for providing electrical energy providing Electric Receptacles in rooms throughout a house or building and the like without the need to run electrical cable, other than relatively short lengths thereof necessary to interconnect Bus Duct contained Busbars, and Baseboard Providing Electric Receptacle Electric Contact Elements. The method of the present invention is found in the ease of installation and maintenance of the system thereof.

In its preferred embodiment, the system of the present invention comprises a Bus Duct System for use in distributing electrical energy to Houses and buildings and the like, which Bus Duct System allows access to electrical energy conducting Busbars therein, along essentially the entire the length thereof, via accessing plug means. That is, electrical energy made available to Bus Duct System Busbars, via a Service Entrance fusible element containing Disconnect System Interface, can be provided to a local circuit in a house or building and the like, by simply plugging a plug means, typically on a Fusible Element Containing Disconnect System, thereinto at a convenient location therealong. In the preferred embodiment said Bus Duct System is accessible via a receptacle which is essentially continuously accessable over the length of the Busbars contained therein.

The present invention System preferred embodiment, in addition, comprises Electric Receptacle Providing Baseboard Systems, such that in use, electrical energy available at said Bus Duct System is made available at locations around the perimeter of a room in a house or building and the like by said Electric Receptacle Providing Baseboard System contained receptacles. In the preferred embodiment the Electric Receptacle Providing Baseboard System receptacles are continuously accessable. That is, rather than discrete element electric receptacles, an Electric Receptacle providing Baseboard System mounted essentially continuously accessable electric receptacle is present. Said Electric Receptacle Providing Baseboard System preferably comprises, as well, as an integrally included provision, a raceway which is easily accessible via a user removable Service Closure. Said raceway is convenient for routing other wiring, such as that associated with telephone, computer, temperature control, security and audio and the like systems.

While practice of the present invention is not necessarily limited to the use of any particular design of Bus Duct System or Electric Receptacle Providing Baseboard System, preferred embodiments of each have been defined.

For instance, regarding the Bus Duct, the preferred embodiment provides that three (3) Busbars, (which are rectangularly shaped in cross-section and longitudinally elongated), be present in an extruded plastic mold, said three (3) busbars being held in essentially parallel orientation with respect to one another, and each being held in spacially separated place by partially surrounding groove structure and spring force providing projecting fingers on one side thereof, and by a containing extended groove structure on the other side and back edge thereof and a lip structure on the front edge thereof. In use three (3) Spades of a Fuseable Element Containing Disconnect System are caused to contact said three (3) Busbars by being forced between said spring force providing fingers and said Busbars. A partially enclosing metal housing serves to contain said extruded plastic mold in a manner which allows spades on a Fused Element Containing Disconnect System, access to said contained Busbars in use. In the preferred embodiment, Fuseable Element Containing Disconnect System spades can access said contained Busbars along essentially the entire length of said Busbars. That is, there are not separately defined receptacles present, but rather, the entire length of a Bus Duct serves as a continuously accessable receptacle.

Prefabricated lengths of Bus Duct System, in use, are coupled by way of "Through Couplers". Said Through Couplers comprising three (3) essentially parallel spades held in appropriate spacial separation by an extruded mold into which they are affixed. In use said three (3) spades insert into adjacent sections of Bus Duct, and provide electrical continuity of Busbars in said coupled adjacent sections of Bus Duct System. A metal band typically serves to wrap around the coupled sections of Bus duct System at their point of contact to one another, via Through Couplers, and is secured thereto by, typically, screws. This serves to provide mechanical strength and to provide electrically grounding conductivity between the enclosing metal housings of said adjacent sections of Bus Duct. End caps, which are similar to Through Couplers, but which have spades projecting from one side thereof only, allow capping the end of a last section of Bus Duct System. As well, "Angled Through Couplers" with, for instance, ninety (90) degree bends present therein, allow Bus Duct Systems to be configured as required by the layout of a house or building and the like. Said Angled Through Couplers, at points of contact with Bus Duct System Sections, are also, typically, secured in place with metal bands. It is noted that typically, mating "Nesting" Projections can be present on the ends of Through Couplers and End Caps to aid with orienting coupled present invention element Sections with respect to one another.

In use a Service Entrance will be accessed by a Fuseable Element Containing Disconnect System Interface, which Fuseable Element Containing Disconnect System Interface effects continuity between Service Entrance electrical energy carrying cables and said present invention Bus Duct System Busbars. This is, typically, accomplished by fusable elements with electrically connected spades on either side thereof being caused to interface between the Busbars of a section of Bus Duct System, and a connection means which provides an appropriate groove at the Service Entrance to effect insertional connection of said spades to incoming electrical energy carrying cables.

A preferred embodiment of the present invention Electric Receptacle Providing Baseboard System provides that three (3) Electric Contact Elements, (of longitudinally elongated and cross-sectional arcuate shape), be contained in an extruded mold in essentially parallel orientation with respect to one another. Said three (3) Electric Contact Elements being held in place in grooves in said extruded mold, which grooves are spaced appropriately such that the two electrical carrying spades of a standard appliance plug will engage the outermost Electric Contact Elements, and a ground lug the middle oriented Electric Contact Element, when a standard appliance plug is plugged thereinto. Said extruded mold also has a user accessable raceway incorporated therein and a snap-on Service Closure cover means. In use wiring such as that for telephone, computer, temperature control, security and audio and the like systems can be run therein. Sections of Electric Receptacle Providing Baseboard System can be coupled by Baseboard Through Couplers, much as were described with respect to the above described Bus Duct System. As well, angled (eg. ninety (90) degree), Baseboard Through Coupler Sections allow configuring coupled sections of Electric Receptacle Providing Baseboard Systems at room corners. Baseboard End Caps allow securing the end of a last Section of Electric Receptacle Providing Baseboard System, and electrical energy providing Bus Duct System Busbar engaging Fuseable Element Containing Disconnect System-Cable-Baseboard Electric Contact Element Coupling Systems, serve to provide interfacing between Bus Duct System Busbars and Electric Receptacle Providing Baseboard System Electric Contact Elements in use. Again, as in the case with the above described Bus Duct System, it is noted that typically, mating "Nesting" Projections are present on the ends of sections of Baseboard Through Couplers and Baseboard End Caps, to aid with orienting coupled present invention element sections with respect to one another. As well, Baseboard Through Couplers and Baseboard End Caps are of an outer dimension and design so that outer edge located ridges thereon overlap interconnected Baseboards when in place in contact with an Electric Receptacle Providing Baseboard System Section.

The present invention will be better understood by reference to the Detailed description Section of this Disclosure and the accompanying Drawings.

SUMMARY OF THE INVENTION

It is therefore a purpose of the present invention to provide a system and method of its use for providing electrical energy to houses and buildings and the like in a manner which reduced cable length requirements.

It is another purpose of the present invention to provide a system and method of its use for providing electrical energy to houses and buildings and the like which utilizes safe, prefabricated, Bus Duct System and Electric Receptacle Providing Baseboard Systems.

It is yet another purpose of the present invention to provide a system and method of its use for providing electrical energy to houses and buildings and the like in which utilized prefabricated Bus Duct System and Electric Receptacle Providing Baseboard Systems are interconnected by Fuseable Element Containing Disconnect System-Cable-Baseboard Supply End Cap Contact Element Coupling Systems.

It is still yet another purpose of the present invention to provide a system for providing electrical energy to houses and buildings and the like which can be installed by a relatively simple to practice method.

It is yet still another purpose of the present invention to provide a system for providing electrical energy to houses and buildings and the like which, when installed, is easy to service.

BRIEF DESCRIPTION OF THE DRAWINGS

FIG. 2 shows an expanded view of a Service Entrance at which electrical energy is provided to a present invention Bus Duct System in said house or building and the like.

FIGS. 6*a* and 6*b* show Top and Front Views of two Sections of present invention Bus Duct System, coupled by a Through Coupler, and showing a Bus Duct terminating End Cap, a Fuseable Element Containing Disconnect System, and a Service Entrance.

FIGS. 7*a* and 7*b* show an unfused plug for use in providing electrical energy from a Bus Duct of the present invention to other than a present invention Electric Receptacle Providing Baseboard System.

FIG. 8 shows a two Sections of a present invention Electric Receptacle Providing Baseboard System interconnected by a Baseboard Through Coupler, with one Section shown provided electrical energy by a Supply End Cap, and with one Section terminated by an Baseboard End Cap. Also shown is an Appliance Plug and a Phone jack.

FIG. 9 shows a Bus Duct Angled Through Coupler for allowing Bus Duct Systems to be constructed with angled bends present therein.

FIGS. 10*a* and 10*b* show Side and Back Elevational views of a Supply End Cap of the present invention.

FIG. 12 shows a Top view of an Angled Baseboard Through Coupler for use in fashioning continuous Electrical Receptacle Providing Baseboard Systems at corners of a room in a house or building and the like.

FIGS. 14*a* and 4*b* show Side and Front Elevational views of a Baseboard End Cap for securing the end of a last Section of Electrical Receptacle Providing Baseboard Systems of the present invention.

DETAILED DESCRIPTION

Figure 1:
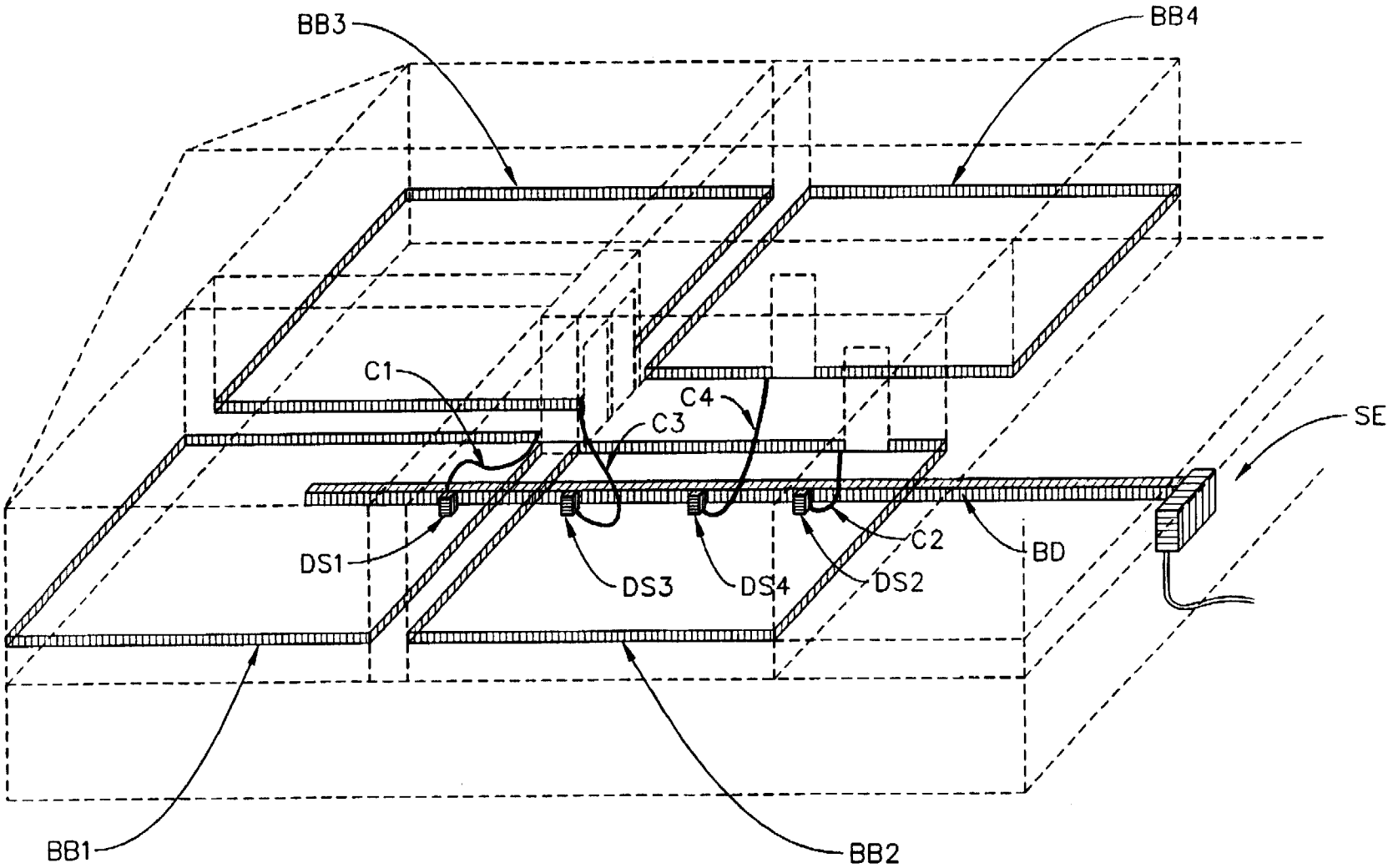
FIG. 1 generally shows a partial view of a house or building and the like including the present invention system for providing electrical energy thereto.

Turning now to the Drawings, there is generally shown in FIG. 1, a partial outline of a house or building and the like including a present invention system for providing electrical energy thereto. Shown are a Service Entrance (SE) to which is attached a Bus Duct System (BD). Plugged into said Bus Duct (BD), at various locations therealong, are Fuseable Element Containing Disconnect Systems (DS1), (DS2), (DS3) and (DS4). Cables, (C1), (C2), (C3) and (C4) are also shown which, respectively, serve to interconnect said Fuseable Element Containing Disconnect Systems (DS1), (DS2), (DS3) and (DS4) to Electric Receptacle Containing Baseboard Systems (BB1), (BB2), (BB3) and (BB4), which are shown as present in various rooms in said house or building and the like. It is noted that it is convenient to consider each Fuseable Element Containing Disconnect System and associated Cable as a "Fusable Element Containing Disconnect System-Cable-Baseboard Electric Contact Element Coupling System". And, as will be demonstrated, (see FIG. 15, which shows present invention FIGS. 3*b* and 10*a* elements interconnected by interconnection Cable (C), by way of an Electric Receptacle Providing Baseboard System Supply End Cap), a "Fuseable Element Containing Disconnect System-Cable-Baseboard Supply End Cap Electric Contact Element Coupling System" can be formed which allows easy provision of Bus Duct System available electrical energy to Electric Receptacles in Electric Receptacle Providing Baseboard Systems of the present invention, utilizing only relatively short lengths of cabling, as compared to the lengths of cabling required when presently typical house and building and the like wiring approaches, (see Background Section), are utilized.

Figure 2:
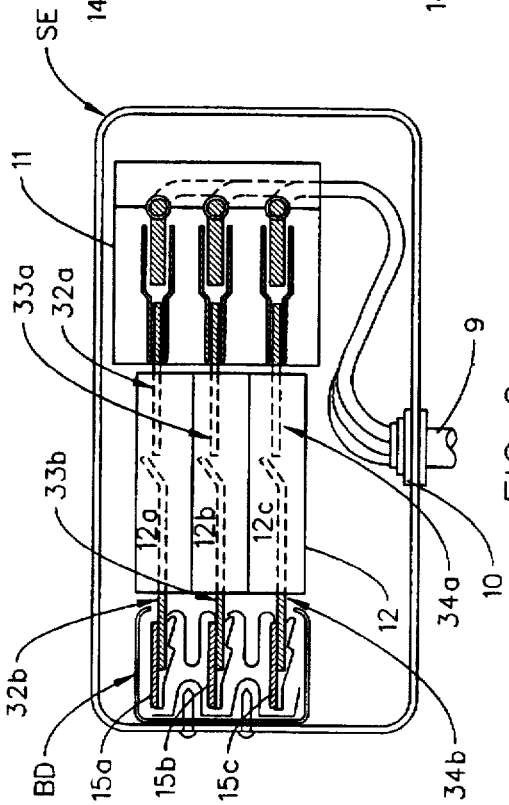

Turning now to FIG. 2, there is shown an expanded view of a Service Entrance (SE), with external electrical energy carrying cable wires (9) entering through conduit access (10), and interfacing with Spade slot receiving means in Cradle (11). Also shown is Fuseable Elements containing Fused Disconnect Block (12), with three (3)Fused Elements therein (12*a*), (12*b*) and (12*c*). Spades (32*a*) and (32*b*), (33*a*) and (33*b*), and (34*a*) and (34*b*) are associated with Fused Elements (12*a*), (12*b*) and (12*c*) respectively. Fused Disconnect Block (12) is shown as providing Interface pathways for electrical energy to access Bus Duct (BD) Busbars (15*a*), (15*b*) and (15*c*), via contact with Spades (32*b*), (33*b*) and (34*b*) respectively.

Figure 3B:
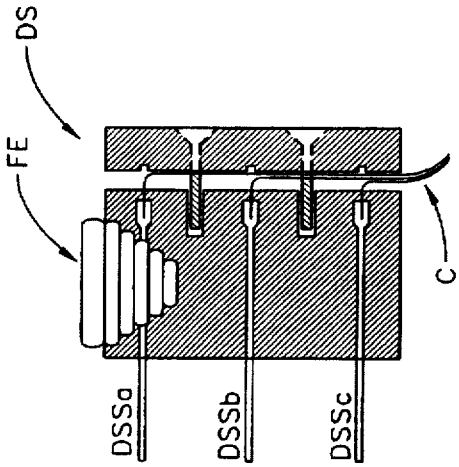
FIG. 3*b*. shows a Fused Element Containing Disconnect System of the present invention for interfacing electrical energy available at a Bus Duct System to Electrical Contact Elements in a present invention Electric Receptacle Providing Baseboard Systems.
Figure 3A:
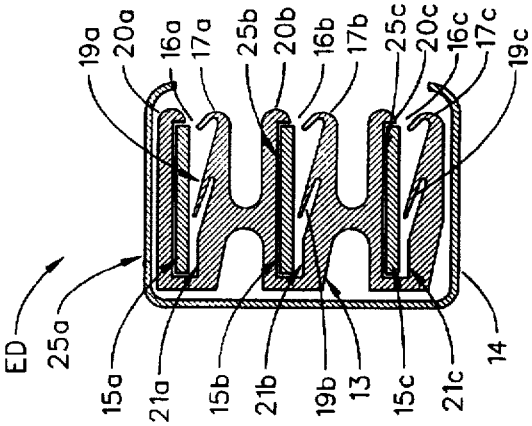
FIG. 3*a* shows a detailed view of a present invention Bus Duct System.

FIG. 3*a* shows a more detailed view of the preferred Bus Duct (BD) construction as viewed in Left Side Cross-Sectional Elevation. A Partially Enclosing Metal Housing (14) is shown as present on three (3) sides of an extruded mold (13). Three essentially cross-sectionally rectangular, and longitudinally elongated, Busbars (15*a*), (15*b*) and (15*c*) are shown held in essentially parallel orientation with respect to one another, each being held in spacially separated place by said extruded mold (13) via partially surrounding groove structures (21*a*), (21*b*) and (21*c*), and spring force providing fingers (17*a*) and (19*a*), and (17*b*) and (19*b*) and (17*c*) and (19*c*) respectively, on one "Side" thereof, and by containing groove structures (25*a*), (25*b*) and (25*c*) respectively on the "Back" and "Opposite Side" thereof. Each Bus Bar (15*a*), (15*b*) and (15*c*) is further held in place at the Front of the Bus Duct, (note that as referred to FIG. 3*a*, "Front" refers to that aspect of the Bus Duct at which electrical energy can be accessed and whereat are located by Lip Structures (20*a*), (20*b*) and (20*c*), and "Back" refers to the side opposite thereto which is enclosed by said Partially Enclosing Metal Housing (14). This language is to be considered as definitive of said identified locations of said Bus Duct geometry).

FIG. 3*b* demonstrates a Fused Element (FE) Containing Disconnect System (DS) with a Cable (C) attached thereto. As shown, it will be appreciated that easy, screw retained, access to Cable (C) contained wires at Spades (DSSa), (DSSb) and (DSSc) is possible by partial disassembly of said Fused Element Containing Disconnect System. Note that Spade (DSSa) is accessed via easily changed Fused Element (FE). (Fused Element (FE) is shown as a typical screw-in Fuse as used in house and building and the like Fuse Panels, but can be a Circuit Breaker means.) Referral to FIG. 1 shows Specific applications of such Fuseable Element Containing Disconnect Systems (DS), as ((DS1), (DS2), (DS3) and (DS4). Note, by reference to FIGS. 3*a* and 3*b* that Spades (DSSa), (DSSb) and (DSSc), (shown in FIG. 3*b*), are oriented and spacially situated so that they can be easily inserted into "Socket" accesses (16*a*), (16*b*) and (16*c*) respectively in the Bus Duct System (BD), (shown in FIG. 3*a*), to access electrical energy provided to Busbars (15*a*), (15*b*) and (15*c*) respectively by Service Entrance (SE) located Fused Disconnect Block (12) Spades (12*a*), (12*b*) and (12*c*) respectively. In use, then, it will be appreciated that said Bus Duct (BD) can provide electrical energy to a Fuseable Element (FE) Containing Disconnect System (DS) at essentially any location along the length thereof where said Fuseable Element (FE) Containing Disconnect System (DS) is plugged thereinto. As mentioned above, Fused Element (FE) Containing Disconnect System (DS) can be disassembled to allow easy access to the ends of Spades (DSSa), (DSSb) and (DSSc) therein. This allows running a Cable (C) to said Fused Element (FE) Containing Disconnect System (DS) through holes in studs and walls etc., and assembly thereto in a field installation. The system shown in FIGS. 3*a* and 3*b* is believed to constitute a novel approach to accessing electrical energy carried by a Bus Duct System for the purpose of providing said electrical energy to an Electric Receptacle Providing Baseboard System, via a Supply End Cap (SEC), (see FIGS. 10*a* and 10*b*).

Figure 4B:
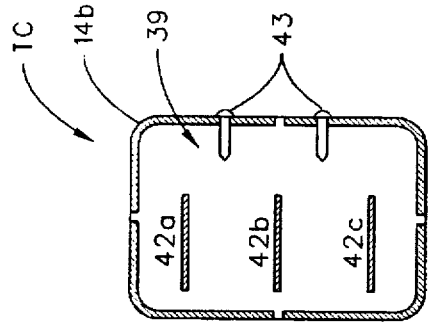
FIGS. 4*a* and 4*b* show Front Cross-Section and Side Elevational views respectively of a Through Coupler for interconnecting Sections of present invention Bus Duct System.
Figure 5B:
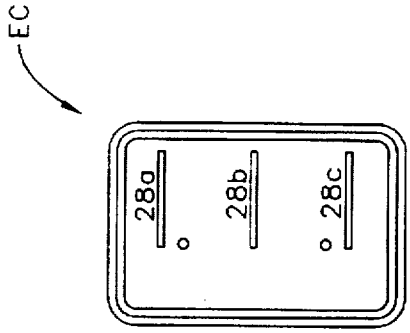
FIGS. 5*a* and 5*b* show Side and Front Elevational views of an End Cap for safely terminating a last Section of Bus Duct System.
Figure 4A:
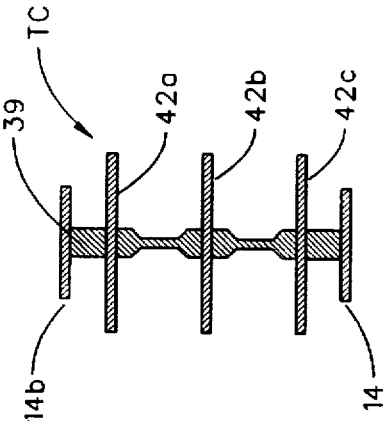
Figure 5A:
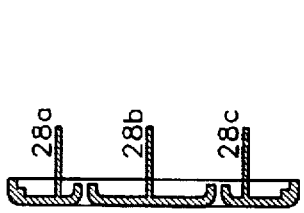

FIGS. 6*a* and 6*b* show the "Tops" and the "Fronts" of two Sections, (BDS1) and (BDS2), of a present invention Bus Duct (BD) system. Partially Enclosing Metal Housing (14) is shown in FIG. 6*a*, as are locations of Busbars (15*a*), (15*b*) and (15*c*) in FIG. 6*b*. Positioning of Service Entrance (SE) contained spade slot receiving means in Cradle (11) and Fuseable Elements containing Fused Disconnect Block (12) is also identified to help orient FIGS. 6*a* and 6*b* with respect to FIGS. 2 and 3. Note that a Through Coupler (TC) is shown between separated Sections of Bus Duct (BDS1) and (BDS2). FIGS. 4*a* and 4*b* (Front Cross-Section Elevational Sides views respectively), show that Through Couplers (TC's) comprise three essentially parallel Spades (42*a*), (42*b*) and (42*c*) which project through said Through Coupler (TC) and are held in appropriate spacial separation by an extruded mold element (39) into which they are affixed. An associated Metal Band (14*b*) is also shown. In use the Spades (42*a*), (42*b*) and (42*c*) are caused to project into the adjacently oriented ends of Bus Duct (BD) Sections, such as (BDS1) and (BDS2) in FIGS. 6*a* and 6*b*, and effect electrical continuity between Busbars (15*a*), (15*b*) and (15*c*) in said two Sections (BSD1) and (BSD2). FIG. 9, which shows a top view of an Angled Through Coupler (TCA), shows that Bus Duct Systems which include, for instance, ninety (90) degree turns can be constructed. Note said Angled Through Coupler (TCA) shows Spades (42*a*) and (42*b*), as well as extruded mold (39*a*). FIGS. 6*a* and 6*b* also show that End Caps (EC) allow securing the end of a last Section (eg. BDS1 in FIGS. 6*a* and 6*b*). FIGS. 5*a* and 5*b* show an extruded End Cap (EC) is side and Frontal Elevation respectively. Note that Spades (28*a*), (28*b*) and (28*c*) are present and situated to allow entry between the Fingers (17*a*) and (19*a*), (17*b*) and (19*b*), and (17*c*) and (19*c*), and Busbars (15*a*), (15*b*) and (15*c*) respectively, (see FIG. 3*a*). FIGS. 6*a* and 6*b* also show the presence of a Fuseable Element (FE) Containing Disconnect Systems (DS) with a Fused Element (FE) and Cable (C) associated therewith, as described with respect to FIG. 3*b*. Note that said Fuseable Element (FE) Containing Disconnect Systems (DS) is simply plugged into said Bus Duct Section (BDS1). Note that many such Fuseable Element Containing Disconnect Systems (DS) can be so plugged into said Bus Duct (BD) System at essentially any position along the length thereof. This is demonstrated in FIG. 1, discussed above.

Turning now to FIG. 8 there is shown a Front Elevational view of an electrical receptacle providing Baseboard System (BB) of the present invention. Shown are Supply End Cap (SEC) with Cable (C), (which can be appropriately considered as a distant end of Cable (C) shown in FIG. 6*b*, which Cable (C) originates at Fuseable Element (FE) Containing Disconnect Systems (DS) which is plugged into Bud Duct Section (BDS1).

Figure 11C:
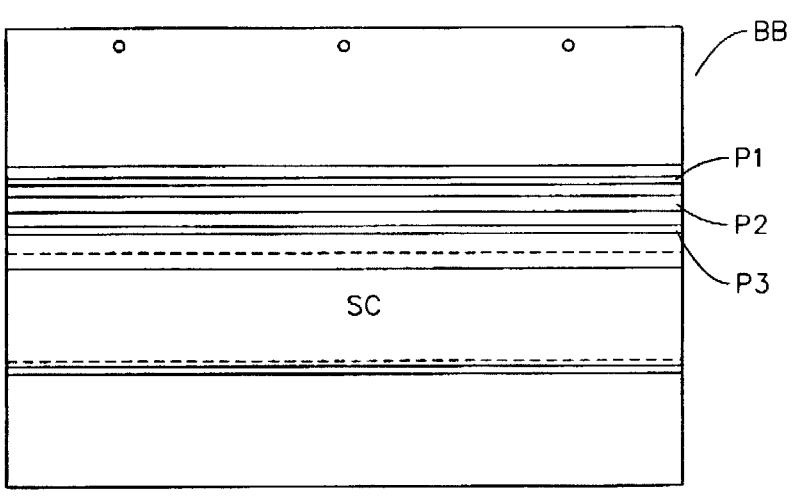
FIG. 11*c* shows a Front Elevational view of the Electrical Receptacle Providing Baseboard System of the present invention shown in FIG. 11*a*.
Figure 11B:
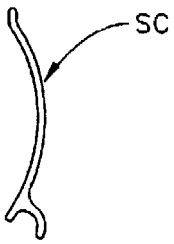
FIG. 11*b* shows a snap-on Service Closure of the Electrical Receptacle Providing Baseboard of the present invention shown in FIG. 11*a*.
Figure 11A:
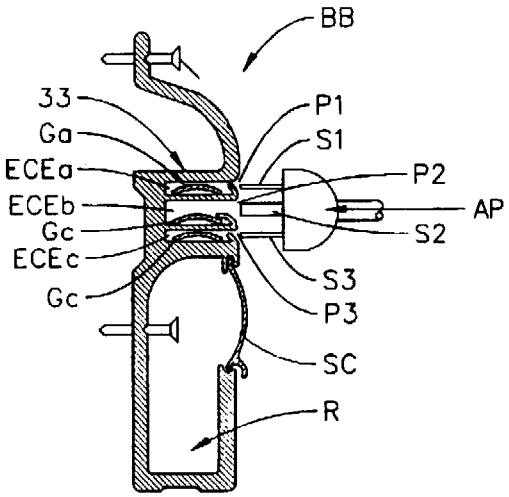
FIG. 11*a* shows a Cross-Section Side Elevational view of an Electrical Receptacle Providing Baseboard of the present invention. Also shown is a Raceway for containing wiring for, for instance, telephone, computer, temperature control, security and audio and the like systems.

FIGS. 10*a* and 10*b* show Side and Back Elevational views of said Supply End Cap (SEC), showing Spades (ECECa), (ECECb) and (ECECc), (which contact FIG. 11*a* demonstrated Electric Receptacle Providing Baseboard (BB) Electric Contacts Elements (ECEa), (ECEb) and (ECEc) respectively), in use. Also shown are Nesting means (N) for use in mating said Supply End Cap (SEC) to an Electric Receptacle Providing Baseboard System (BB). Note that in combination with the FIG. 3*b* Fused Element (FE) Containing Disconnect System (DS) with a Cable (C) attached thereto, the A FIG. 10*a* and 10*b* Supply End Cap (SEC) allow easy interconnection of electrical energy available at the Bus Duct System of FIG. 3*a*, to the Electrical Contact Elements of Electric Receptacle Providing Baseboard Systems as shown in FIG. 11*a*. It is felt that the use of a "Fuseable Element Containing Disconnect System-Cable-Baseboard Supply End Cap Electric Contact Element Coupling System", (see FIG. 15), as formed by interconnection of wires in the Cables (C) shown in FIGS. 3*b* and 10*b*, in providing electrical energy available at a Bus Duct System, (see FIG. 3*a*), to Electric Receptacles in Electric Receptacle Providing Baseboard Systems, (see FIG. 11*a*), is demonstrative of Patentable Utility. As compared to the typical wiring approach electricians presently utilize in providing electrical energy to rooms in houses and buildings and the like, as was described in the Background Section of this Disclosure, the ease of installation of the present invention, and associated inherent safety of the resulting system thereof, can be appreciated as providing dramatically contrast.

Continuing, FIG. 11*a* shows a Side Cross-Section Elevational view of a preferred embodiment Electric Receptacle Providing Baseboard System (BB). Shown are extrusion mold (33) which contains a snap-on Service Closure (SC) accessible Raceway (R). Said Raceway (R) is convenient for use in the running of wires for telephone, computer, temperature control, security and audio and the like systems. (Note that a Phone Jack (PJ) is shown as present in the vicinity of the Raceway (R) in FIG. 8). Also note that arcuate shaped Electrical Contact Elements (ECEa), (ECEb) and (ECEc) are present and held in essentially parallel orientation with respect to one another in grooves (Ga), (Gb) and (Gc) respectively, in extrusion mold (33), which Grooves (Ga), (Gb) and (Gc) are spaced appropriately so that two power carrying spades (S1) and (S3) of a standard Appliance Plug (AR) will engage the outermost positioned Electrical Contact Elements (ECEa) and (ECEb), while a Ground Spade (S2) will engage the mid positioned Electrical Contact Element (ECEb), when said Applicance Plug (AP) is plugged thereinto at some point along the length thereof. Note that the Spades (S1), (S2) and (S3) of a standard Appliance Plug (AP) enter said Electrical Receptacle Providing Baseboard System (BB) at slots (P1), (P2) and (P3) therein. FIG. 11*c* shows a Front Elevational view of an Electrical Receptacle Providing Baseboard System (BB), and FIG. 11*b* shows the snap-on Service Closure (SC) shown in place in FIG. 11*a*, separately.

Figure 13B:
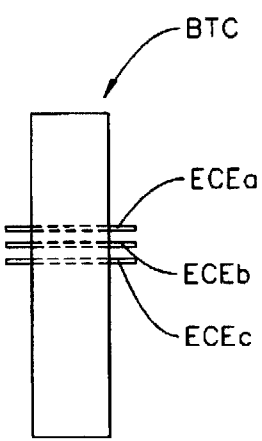
FIGS. 13*a* and 13*b* show Side and Front Elevational views of a Baseboard Through Coupler for use in interconnecting Sections of Electrical Receptacle Providing Baseboard System of the present invention.
Figure 13A:
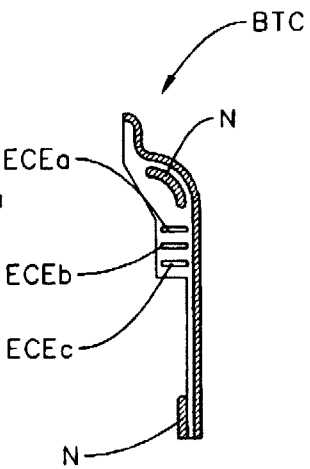
Figure 12:
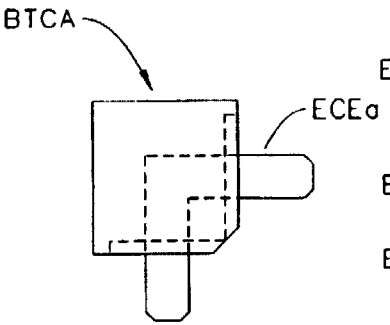

FIGS. 13*a* and 13*b* show Side Elevational and Front Views of a Baseboard Through Coupler (BTC) for use in electrical interconnecting the Electrical Contact Elements (ECEa), (ECEb) and (ECEc) in adjacent Sections of Electrical Receptacle Providing Baseboard System (BB) Sections, as demonstrated in FIG. 8 wherein Electrical Receptacle Providing Baseboard System (BB) Sections (BBS1) and (BBS2) are shown interconnected by Baseboard Through Coupler (BTC). FIG. 12 shows a top view of an Angled Baseboard Through Coupler (BTCA) for use in fashioning continuous Electrical Receptacle Providing Baseboard Systems (BB) at room corners where, for instance, a ninety (90) degree bend is required. Note also the presence of Nesting means (N) for aiding in aligning said Baseboard Through Couplers (BTC's) with Electrical Receptacle Providing Baseboard System (BB) Sections.

Figure 14B:
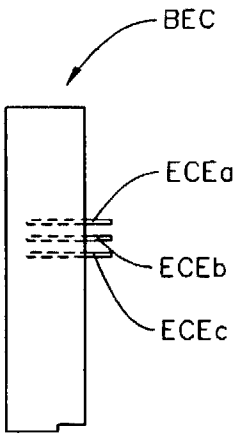
Figure 14A:
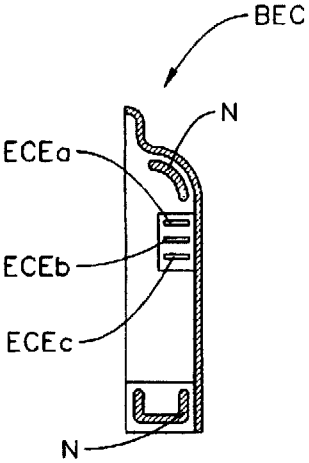

FIGS. 14*a* and 14*b* show Side and Front Elevational views of an Electrical Receptacle Providing Baseboard Systems (BB) End Cap (BEC), for use in securing the end of a last Section of a Electrical Receptacle Providing Baseboard Systems (BB), such as shown in FIG. 8. Note also the presence of Nesting means (N) for aiding in aligning said Electrical Receptacle Providing Baseboard Systems (BB) End Cap (BEC's) with Electrical Receptacle Providing Baseboard System (BB) Sections.

FIG. 7*a* and 7*b* show a plug system for use in providing electrical energy from a Bus Duct (BD) as shown in FIGS. 6*a* and 6*b*, to other than an Electrical Receptacle Providing Baseboard System (BB), such as, for instance, a light switch. Such a plug might be provided with a Fuseable Element as well, much as is shown in FIG. 3*b* for a Fused Element (FE) Containing Disconnect System (DS) used to interface electrical energy from a Bus Duct (BD) to an Electrical Receptacle Providing Baseboard System (BB).

Figure 15:
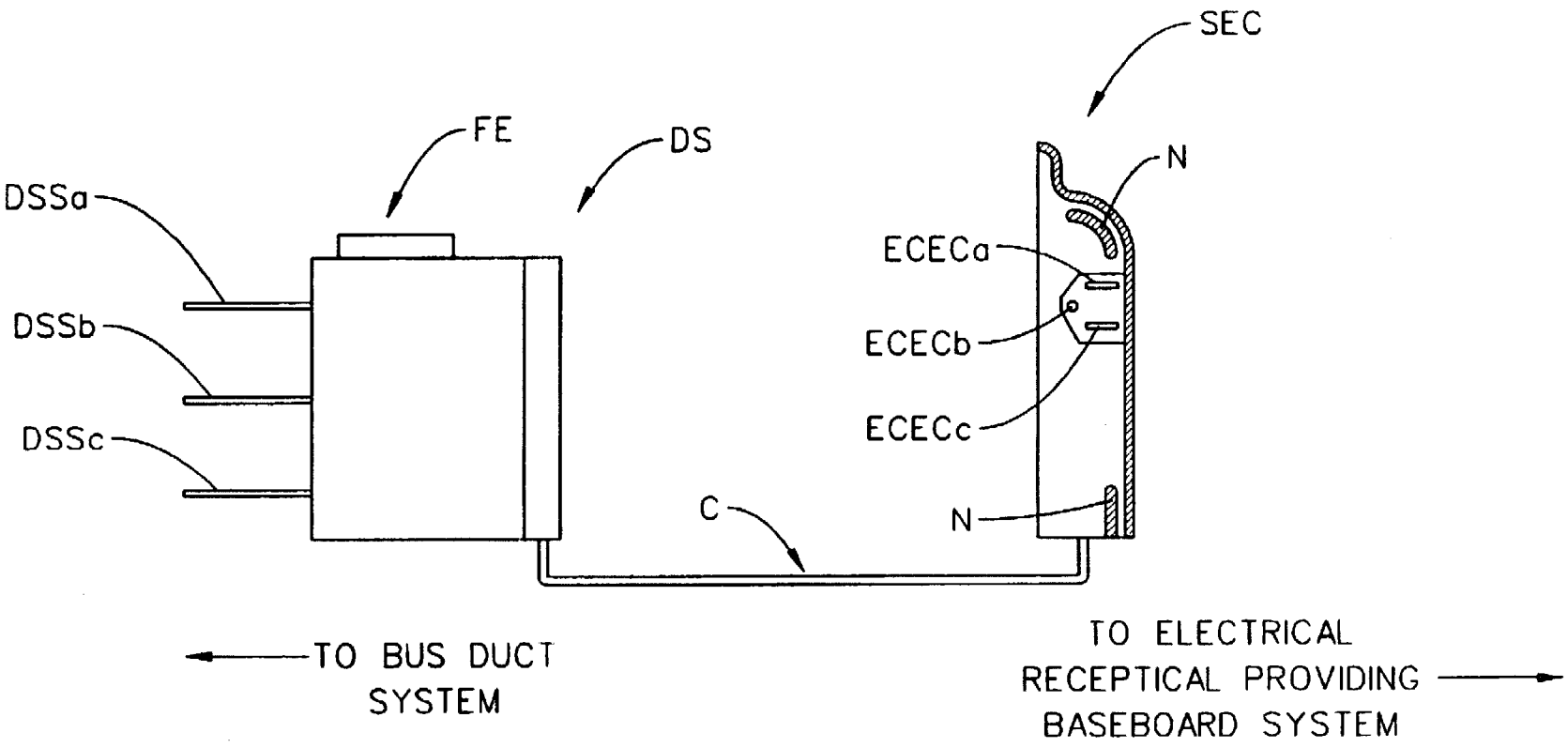
FIG. 15 shows a present invention "Fused Element Containing Disconnect System-Cable-Baseboard Supply End Cap Electric Contact Element Coupling System" which allows providing electrical energy present at a Bus Duct System to Electric Recepticles present in rooms in houses and buildings and the like, with only minimal cable length requirements.

FIG. 15 shows a combination of present invention system elements shown in FIGS. 3*b* and 10*a*, interconnected by a Cable (C), said combination comprising a "Fuseable Element Containing Disconnect System-Cable-Baseboard Supply End Cap Electric Contact Element Coupling System". Note that Cable (C) is the only cable required by the present invention to provide electrical energy to Electric Receptacles in Electric Receptacle Providing Baseboard Systems throughout rooms in houses and building and the like, hence the present invention has reduced cabling requirements, as compared to typical present practice. The use of said "Fuseable Element Containing Disconnect System-Cable-Baseboard Supply End Cap Electric Contact Element Coupling System" enables an easy to practice, reduced cable length requiring, safety enhancing approach to providing electrical energy to houses and buildings and the like, and as described above, is considered to be an important focus of the present invention.

It is further noted that plug-in covers which protect the essentially continuous Electric Receptacles in the Electric Receptacle Providing Baseboards, and Busbars of the Bus Duct Systems, of the present invention can be provided to prevent dirt build-up therein where not accessed by Applicance Plugs (AP's) or Fusible Element (FE) Containing Disconnect Systems (DS) respectively.

As well, it is to be understood that while Electric Receptical Providing Baseboards were described, in practice said Electric Receptical Providing Baseboards need not be mounted in a room of a house or building and the like just above the floor therein at the base of a wall to be within the scope of the present invention. Said Electric Receptical Providing Baseboards can be mounted at any height above such a floor, such as along Kitchen counters for instance, and be within the scope of the present invention.

It is also to be understood that while the present Disclosure and Drawings utilized a typical one-hundred-ten (110) volt system, the present invention can be applied to other voltage systems, (eg. two-hundred-twenty (220) volt). The use of a typical one-hundred-ten (110) volt system in the Disclosure and in the Drawings herein is then to be understood as demonstrative, and not limiting of the present invention.

Having hereby disclosed the subject matter of this invention, it should be obvious that many modifications and substitutions and variations of the present invention are possible in light of the teachings. It is therefore to be understood that the invention may be practiced other than as specifically described, and should be limited in breadth and scope only by the Claims.

I claim:

1. A system for providing electrical energy to houses and buildings, and houses and buildings including said system, said system for providing electrical energy to houses and buildings comprising, in functional combination:

a. a busduct system which contains busbars;

b. at least one baseboard system which contains electric contact elements, each of which electric contact elements electrically corresponds to a busbar in said busduct system; and c. at least one cable means for, in use, functionally electrically interconnecting said busbars and said electrically corresponding electric contact elements;

each of said at least one cable means being comprised of a disconnect system at one end thereof, which disconnect system comprises three (3) busbar contacting spades which project in a common direction therefrom, and which disconnect system further comprises an electrical system protecting fused element, said three (3) busbar contacting spades being secured in position with respect to one another in said disconnect system with spacing therebetween which functionally matches spacing between busbars in said busduct system, such that when, in use, said three (3) busbar contacting spades are caused to be simultaneously removably plugged into said busduct system, each said busbar contacting spade simultaneously functionally, electrically contacts a separate busbar therein; said cable means further comprising, at a distally located end of said cable means, a means for functionally, electrically accessing three (3) electric contact elements in an electric receptacle in a baseboard system;

said busduct system being comprised of a plurality of functionally interconnected extruded sections, each said extruded section comprising three (3) busbars which, in use, are functionally, electrically interconnected with three (3) busbars from other present extruded sections, said interconnected busbars being provided electrical energy at a service entrance, each of said busbars in each said extruded section being rectangular shaped in cross-section and longitudinally elongated, said rectangular shape providing two major surface area sides and two minor surface area edges over a length thereof; a major surface area side of each of said three (3) busbars being individually accessible by one of said three (3) busbar contacting spades which project from said cable means disconnect system, said access being along essentially the entire length of said busbars in said busduct system, said three (3) busbars in each extruded section being held in spacially separated essentially parallel orientation with respect to one another by said extrusion, which extrusions secure each specific busbar in a separate partially surrounding groove, said extrusions further comprising spring force providing fingers associated with each busbar and positioned in said extrusions such that when said three busbar contacting spades of a cable means disconnect system are simultaneously caused to be plugged into said bus duct system, each through an opening in a separate busbar containing partially surrounding groove, said spring force providing fingers serve to force a busbar contacting spade with which said spring force providing finger makes contact, into functional, electrical contact with a major surface area side of a busbar contacted by said busbar contacting spade, each extruded section of said bus duct system further comprising a partially surrounding metal encasement;

each of said at least one baseboard system(s) being comprised of a plurality of functionally interconnected extruded sections, each said extruded section comprising an electric receptacle which is continuously accessible along essentially the entire length of an extruded section, said electric receptacle in each extruded section comprising three (3) electric contact elements, said three (3) electric contact elements in an extruded section being, in use, functionally, electrically interconnected with three (3) electric contact elements in other present extruded sections, said three (3) electric contact elements in each extruded section each being of an arcuate shape in cross section, longitudinally elonagated, and held in essentially constant spacially separated parallel orientation with respect to one another throughout each baseboard system extruded section, such that, in use, two electrical energy carrying spades of a standard appliance plug caused to be plugged into an electric receptacle of a baseboard system extruded section will engage two of said electric contact elements and a ground lug of said standard appliance plug will simultaneously contact the third electric contact element, thereby enabling provision of electrical energy to an appliance;

such that in use, for a present baseboard system, one of said cable means is caused to functionally provide electrical energy from said busbars in said bus duct system to electrically corresponding electric contact elements in said present baseboard system, by the plugging of busbar contacting spades of said cable means disconnect system into said bus duct system.

2. A system for providing electrical energy to houses and buildings, and houses and buildings including said system as In claim 1, in which at least one baseboard system extruded section further comprises a raceway for containing wiring required by telephone, computer, temperature control, security and audio systems.

3. A method of providing electrical energy in houses and buildings comprising, in a functional order, the steps of:

a. providing a system for providing electrical energy to houses and buildings comprising:

a. a busduct system which contains busbars;

b. at least one baseboard system which contains electric contact elements, each of which electric contact elements electrically corresponds to a busbar in said busduct system; and c. at least one cable means for, in use, functionally electrically interconnecting said busbars and said electrically corresponding electric contact elements;

each of said at least one cable means being comprised of a disconnect system at one end thereof, which disconnect system comprises three (3) busbar contacting spades which project in a common direction therefrom, and which disconnect system further comprises an electrical system protecting fused element, said three (3) busbar contacting spades being secured in position with respect to one another in said disconnect system with spacing therebetween which functionally matches spacing between busbars in said busduct system, such that when, in use, said three busbar contacting spades are caused to be simultaneously removably plugged into said busduct system, each said busbar contacting spade simultaneously functionally, electrically contacts a separate busbar therein; said cable means further comprising, at a distally located end of said cable means, a means for functionally, electrically accessing three (3) electric contact elements in an electric receptacle in a baseboard system;

said busduct system being comprised of a plurality of functionally interconnected extruded sections, each said extruded section comprising three (3) busbars which, in use, are functionally, electrically interconnected with three (3) busbars from other present extruded sections, said interconnected busbars being provided electrical energy at a service entrance, each of said busbars in each said extruded section being rectangular shaped in cross-section and longitudinally elongated, said rectangular shape providing two major surface area sides and two minor surface area edges over a length thereof; a major surface area side of each of said three (3) busbars being individually accessible by one of said three (3) busbar contacting spades which project from said cable means disconnect system, said access being along essentially the entire length of said busbars in said busduct system, said three (3) busbars in each extruded section being held in spacially separated essentially parallel orientation with respect to one another by said extrusion, which extrusions secure each specific busbar in a separate parallel surrounding groove, said extrusions further comprising spring force providing fingers associated with each busbar and positioned In said extrusions such that when said three (3) busbar contacting spades of a cable means disconnect system are simultaneously caused to be plugged into said bus duct system, each through an opening in a separate busbar containing partially surrounding groove, said spring force providing fingers serve to force a busbar contacting spade with which said spring force providing finger makes contact, into functional, electrical contact with a major surface area side of a busbar contacted by said busbar contacting spade, each extruded section of said bus duct system further comprising a partially surrounding metal encasement;

each of said at least one baseboard system(s) being comprised of a plurality of functionally Interconnected extruded sections, each said extruded section comprising an electric receptacle which is continuously accessible along essentially the entire length of an extruded section, said electric receptacle in each extruded section comprising three (3) electric contact elements, said three (3) electric contact elements in an extruded section being, in use, functionally, electrically interconnected with three (3) electric contact elements in other present extruded sections, said three (3) electric contact elements in each extruded section each being of an arcuate shape in cross section, longitudinally elongated, and held in essentially constant spacially separated parallel orientation with respect to one another throughout each baseboard system extruded section, such that, in use, two electrical energy carrying spades of a standard appliance plug caused to be plugged into an electric receptacle of a baseboard system extruded section will engage two of said electric contact elements and a ground lug of said standard appliance plug will simultaneously contact the third electric contact element, thereby enabling provision of electrical energy to an appliance;

such that in use, for a present baseboard system, one of said cable means is caused to functionally provide electrical energy from said busbars in said bus duct system to electrically corresponding electric contact elements in said present baseboard system, by the plugging of busbar contacting spades of said cable means disconnect system into said bus duct system;

b. installing said bus duct system in a structure selected from the group consisting of a house and a building, such that said bus duct system extends from a service entrance into said structure, and such that busbars in said bus duct system are provided electrical energy from a service entrance;

c. installing at least one baseboard system, in said structure selected from the group consisting of a house and a building; and d. by use of a cable means, functionally electrically interconnecting said busbars in said bus duct system with electrically corresponding electric contact elements in said at least one baseboard system, by plugging the busbar contacting spades of said cable means into said bus duct system.

* * * * *